US012384586B2

(12) United States Patent
Seo

(10) Patent No.: US 12,384,586 B2
(45) Date of Patent: Aug. 12, 2025

(54) AUTOMATIC SYSTEM HEAT FUSION-TYPE BINDING MACHINE FOR GARDENING AND CONTROL METHOD THEREOF

(71) Applicant: UVA TOOLS Co, LTD, Daejeon (KR)

(72) Inventor: Sang Ki Seo, Daejeon (KR)

(73) Assignees: UVA TOOLS Co, LTD, Daejeon (KR); Sang Ki Seo, Daejeon (KR)

( * ) Notice: Subject to any disclaimer, the term of this patent is extended or adjusted under 35 U.S.C. 154(b) by 0 days.

(21) Appl. No.: 18/653,072

(22) Filed: May 2, 2024

(65) Prior Publication Data

US 2024/0367842 A1 Nov. 7, 2024

(30) Foreign Application Priority Data

May 4, 2023 (KR) ..... 10-2023-0058188

(51) Int. Cl.

| | |
|---|---|
| ***B65B 13/00*** | (2006.01) |
| ***B65B 13/02*** | (2006.01) |
| ***B65B 13/32*** | (2006.01) |
| ***B65B 27/12*** | (2006.01) |
| ***B65B 57/10*** | (2006.01) |
| ***B65B 61/06*** | (2006.01) |

(52) U.S. Cl.

CPC ..... *B65B 57/10* (2013.01); *B65B 13/025* (2013.01); *B65B 13/327* (2013.01); *B65B 27/12* (2013.01); *B65B 61/06* (2013.01)

(58) Field of Classification Search

CPC ..... B65B 13/327; B65B 13/025; B65B 13/32; B65B 13/20; B65B 13/18; B65B 13/16; B65B 13/22; B65B 13/345

USPC ... 53/589, 582, 399, 592, 529, 588, 64, 586, 53/590, 477

See application file for complete search history.

(56) References Cited

U.S. PATENT DOCUMENTS

| | | | | |
|---|---|---|---|---|
| 4,534,817 | A * | 8/1985 | O'Sullivan | B29C 65/78 156/352 |
| 2007/0034338 | A1* | 2/2007 | Ogawa | A01G 17/08 156/468 |
| 2017/0359971 | A1* | 12/2017 | Hayashi | A01B 1/00 |
| 2017/0359973 | A1* | 12/2017 | Taguchi | B65B 13/16 |

* cited by examiner

*Primary Examiner* — Jacob A Smith

(74) *Attorney, Agent, or Firm* — Studebaker Brackett PLLC

(57) ABSTRACT

The present disclosure relates to a heat fusion-type binding machine for gardening, which performs a work of binding a crop and a support to each other by heat fusing a tape. The machine includes: a handle body; a tape supply unit including a tape container, and a tape guide unit; a power supply unit disposed at the handle body and supplying power for the heat fusion of the tape; a pair of arms facing each other, coupled to one side of the handle body for at least one arm to be pivotable to thus form a binding region along its inner periphery, and each having one end opened during the binding work to form an opening through which the crop and the support enter or exit the binding region; and a pivotal coupling unit pivotably coupling the other end of each of the pair of arms to the handle body.

12 Claims, 9 Drawing Sheets

AUTOMATIC SYSTEM HEAT FUSION-TYPE BINDING MACHINE FOR GARDENING AND CONTROL METHOD THEREOF

CROSS-REFERENCE TO RELATED APPLICATION(S)

This application claims benefit of priority to Korean Patent Application No. 10-2023-0058188 filed on May 4, 2023 in the Korean Intellectual Property Office, the disclosure of which is incorporated herein by reference in its entirety.

BACKGROUND

1. Field

The present invention relates to an automatic system heat fusion-type binding machine and a method thereof for gardening, and more particularly, to an automatic system heat fusion-type binding machine and a method thereof for gardening, in which the binding machine may perform a tape binding work on a young seedling or a stem of a certain crop by binding its stem by using a fusion hot wire, and the machine may maintain not only a constant binding force and reduce a binding work fatigue even during repetitive binding works, but also increase the speed and binding efficiency of the binding work by automatically setting up the tape binding work.

2. Description of Related Art

In general, a horticultural crop such as a fruit, a vegetable, and a flower, or a certain crop, due to its growth nature, may easily fall over, sag, or even have a stem that has fallen to the ground, which is caused by branch and fruit weights, wind and rain, or a stem weight itself, thus requiring an appropriate fixing work of the crop.

Accordingly, for the young seedling or the certain crop, a support pole may be established at an appropriate distance, a drawstring may be installed on the support pole, and the stem or branch of the crop may then be fixed by being bound to the support pole or the drawstring.

For the fixation, a binding machine for gardening in the prior art suggests the following: a front end of a tape that comes out of a tape container by a tape guide may be captured by the hook lever and pressure lever of a head installed on a machine arm when a worker tightens the arm one time by pressing a handle while holding the tape guide and the handle; the tape is towed and withdrawn while being captured by the hook lever and the pressure lever when the tape guide and the arm are opened in this state; and two ends of the tape, wound around the crop branch and the support pole or the drawstring are bound to each other by an iron needle of a stapler and simultaneously cut by a cutting blade installed on a handle frame of the machine when the worker hangs on the tape on the crop branch and the support pole or the drawstring, winds the tape around the same, and then tightens the arm by pressing the tape guide and the handle with a stronger strength than before. However, such a configuration uses the stapler to bind the two ends of the tape to each other. Therefore, the iron needle used in this stapler method may cause the iron needle to be stuck in the crop stem or various problems that occur in later separation work.

For the fixation, the improved prior art suggests a binding machine for gardening which improves this problem of the prior art.

A heat fusion-type binding machine for gardening in the improved prior art suggests a taper instead of the stapler that supplies the iron needle, and this synthetic resin tape may be partially melted by heat to thus bind two ends of the tape to each other.

However, in a prior heat fusion method, the worker is required to directly press the handle frame of the binding machine. Therefore, a binding force may depend on the press strength and time of the worker, which may result in a binding quality depending on a different worker experience, or depending on a different worker even with the same experience.

In addition, when performing a large-scale binding work, the worker is required to press the binding machine hundreds or thousands of times, and may thus have increased hand fatigue, which may lead to lower work efficiency.

As a result, there is a need for a method for acquiring a consistent binding work quality regardless of the worker's work ability, and simultaneously increasing the binding work efficiency, while reducing the binding work fatigue of the worker during the binding work.

SUMMARY

The present invention has been made in an effort to solve the problems described above, and an object of the present invention is to provide an automatic system heat fusion-type binding machine and a method thereof for gardening, in which the machine may not only reduce a worker's hand fatigue and maintain a binding force at a constant level, but also secure an increased speed of a binding work by forming a binding region where a pair of arms face each other and at least one arm is pivotable, and automatically performing the binding work from a tape fusion work, to a cutting work, and up to a finishing work.

Objects of the present invention are not limited to the above-mentioned objects. That is, other objects that are not mentioned may be obviously understood by those skilled in the art to which the present invention pertains from the following description.

According to an aspect of the present invention, provided is a heat fusion-type binding machine for gardening, which performs a work of binding a crop and a support to each other by heat fusing a tape, the machine including: a handle body; a tape supply unit including a tape container attached to the handle body and mounted with the tape, and a tape guide unit guiding withdrawal of the tape; a power supply unit disposed at the handle body and supplying power for the heat fusion of the tape; a pair of arms facing each other, coupled to one side of the handle body for at least one arm to be pivotable to thus form a binding region along its inner periphery, and each having one end opened during the binding work to form an opening through which the crop and the support enter or exit the binding region; a pivotal coupling unit pivotably coupling the other end of each of the pair of arms to the handle body; and a control unit controlling the pivotal coupling unit to automatically pivot at least one of the pair of arms to perform the binding work.

The pivotal coupling unit may include an arm driving unit controlling the pivoting of at least one of the pair of arms for the pair of arms to be opened or closed at a predetermined angle, and the pair of arms may include a first arm having a withdrawal passage formed along a withdrawal path of the tape therein, and having a withdrawal opening which is formed in its one end and through which the tape is withdrawn to the outside, and a second arm facing the withdrawal opening of the first arm, and including a tape tow unit controlled to capture an end of the tape withdrawn through the withdrawal opening of the first arm when the tape is towed.

The machine, in which the binding work includes a tape withdrawal step of controlling the tape tow unit to capture the end of the tape withdrawn through the withdrawal opening, and withdraw the tape while the pair of arms is opened at the predetermined angle, wherein the second arm further includes a tape tow driving unit driving the tape tow unit for the tape tow unit to capture the end of the tape in the tape withdrawal step.

The machine, in which the binding work further includes a work standby step of standing by until the crop and the support pass through the opening while the tape is put between the one end of the first arm and the one end of the second arm by crossing the opening after the tape withdrawal step, and an insertion detection step of detecting whether the crop and the support pass through the opening formed between the one end of the first arm and the one end of the second arm from the outside to the binding region, may further include a withdrawal length detection unit disposed on a certain point in the withdrawal path of the tape and detecting a withdrawal length of the tape, in the insertion detection step.

The machine, in which the binding work further includes a heat fusion/cutting step of heat fusing/cutting the tape by pressing the one end of each of the pair of arms when the tape is withdrawn to a predetermined withdrawal length or more in the insertion detection step, may further include: a fusion hot wire disposed at the one end of either one of the pair of arms, and heat fusing the tape when the one ends of the pair of arms press the tape against each other in the heat fusion/cutting step; and a cutting blade disposed at the one end of either one of the pair of arms, and cutting the heat fused tape in the heat fusion/cutting step.

The machine may further include a heat detection sensor unit disposed at the one end of the other one of the pair of arms that faces the fusion hot wire, and detecting a fusion temperature during the heat fusion performed in the heat fusion/cutting step, wherein the heat fusion is continued until the fusion temperature reaches a predetermined temperature or a fusion time elapses a predetermined time.

The machine, in which the binding work further includes a binding completion step of completely binding the crop and the support to each other by the heat fused tape after the heat fusion/cutting step, wherein the arm driving unit pivots the pair of arms at the predetermined angle to form the opening for the crop and the support, which are completely bound to each other in the binding completion step, to exit the binding region.

The machine may further include an entry detection sensor disposed at the one ends of the pair of arms, and detecting that the crop and the support enter or exit through the opening, wherein the binding completion step is continued until the crop and the support, which are completely bound to each other, are detected as already exiting the binding region by the entry detection sensor, or until a predetermined time elapses after the heat fusion/cutting step.

The machine may be automatically controlled for the binding work to enter the tape withdrawal step after the binding completion step.

According to another aspect of the present invention, provided is a control method of the automatic system heat fusion-type binding machine for gardening described above, the method including: a binding work preparation step in a state where a pair of arms is opened at a predetermined angle, and a portion of a tape is withdrawn through a withdrawal opening formed in one end of either one of the pair of arms; a tape withdrawal step of capturing an end of the tape, withdrawn through the withdrawal opening, by the other arm side of the pair of arms after the pair of arms is closed, and withdrawing the tape while the pair of arms is opened at the predetermined angle; an insertion detection step of detecting whether a crop and a support pass through an opening formed between one ends of the pair of arms from the outside to a binding region; a heat fusion/cutting step of heat fusing/cutting the tape by pressing the one end of each of the pair of arms after the crop and the support enter the binding region; and a binding completion step of completely binding the crop and the support to each other by the heat fused tape.

The method, in which the machine further includes a withdrawal length detection unit disposed on a certain point in a withdrawal path of the tape, and detecting a withdrawal length of the tape in the insertion detection step, wherein the heat fusion/cutting step is performed when the tape is determined to be withdrawn to a predetermined withdrawal length or more by the withdrawal length detection unit in the insertion detection step.

The heat fusion in the heat fusion/cutting step may be continued until a fusion temperature reaches a predetermined temperature or a fusion time elapses a predetermined time.

DETAILED DESCRIPTION

Embodiments of the present invention are described in detail as follows with reference to the accompanying drawings. The following detailed description is merely an example, and merely illustrates embodiments of the present invention.

Figure 1:
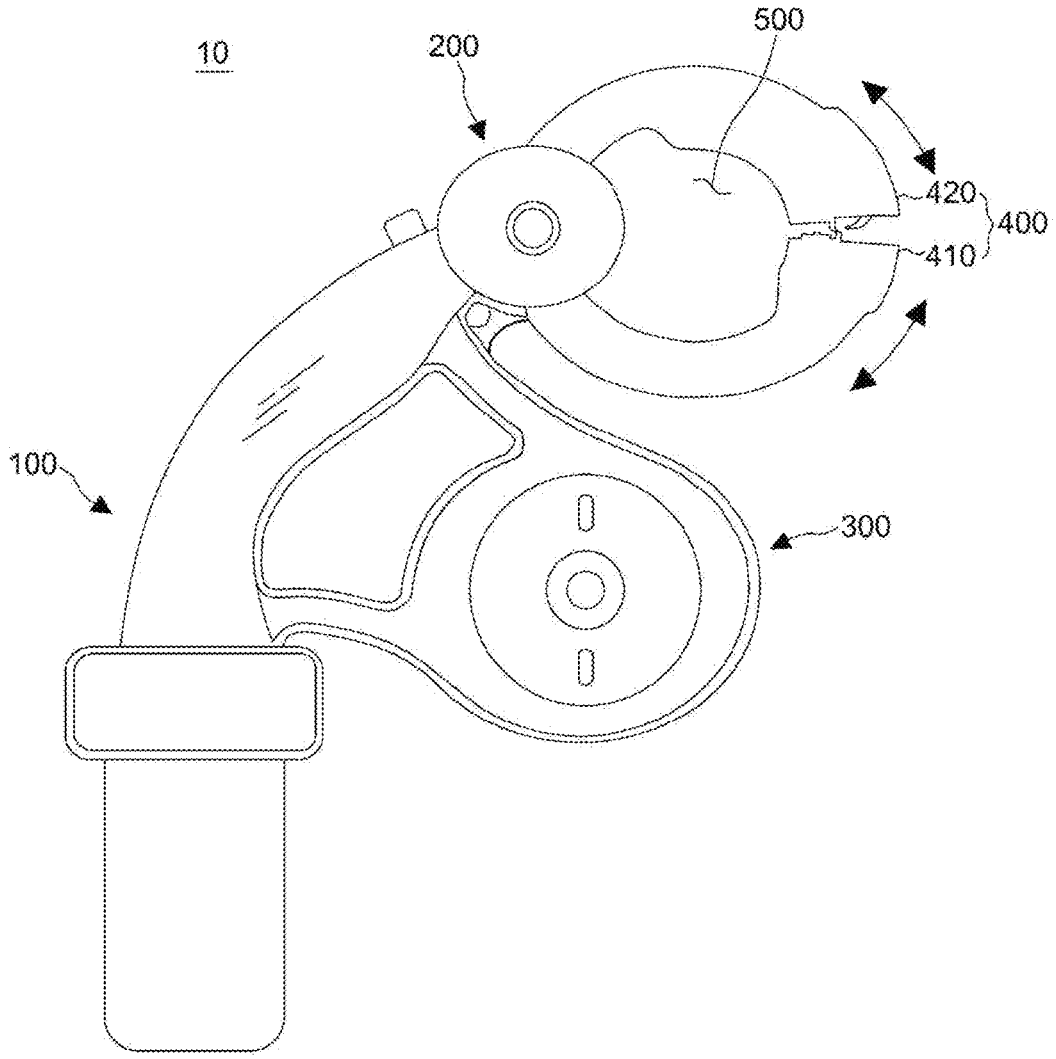
FIG. 1 is a diagram showing an external configuration of an automatic system heat fusion-type binding machine for gardening according to the present invention.

FIG. 1 is a diagram showing an external configuration of an automatic system heat fusion-type binding machine for gardening according to the present invention.

Referring to FIG. 1, the automatic system heat fusion-type binding machine for gardening, which binds the stem or branch of a crop and a support pole or a drawstring (i.e., support) to each other by using an electric heat fusion method to ensure that the horticultural crop or the agricultural crop properly grows, may perform a binding work in such a way that a handle body 100, a tape supply unit 300 attached to the handle body and mounted with a tape to supply the tape, or a pair of arms 400 performing the binding work is pivoted by a pivotal coupling unit 200.

Through this configuration, the automatic system heat fusion-type binding machine 10 for gardening may perform the binding work of binding the stem or branch of the horticultural crop or the agricultural crop and the support pole or the drawstring to each other by heat fusing a tape T inserted between the pair of arms 400, the pair of arms 400 facing each other and being coupled to the pivotal coupling unit for at least one arm to be pivotable to thus form a binding region along its inner periphery.

Figure 2:
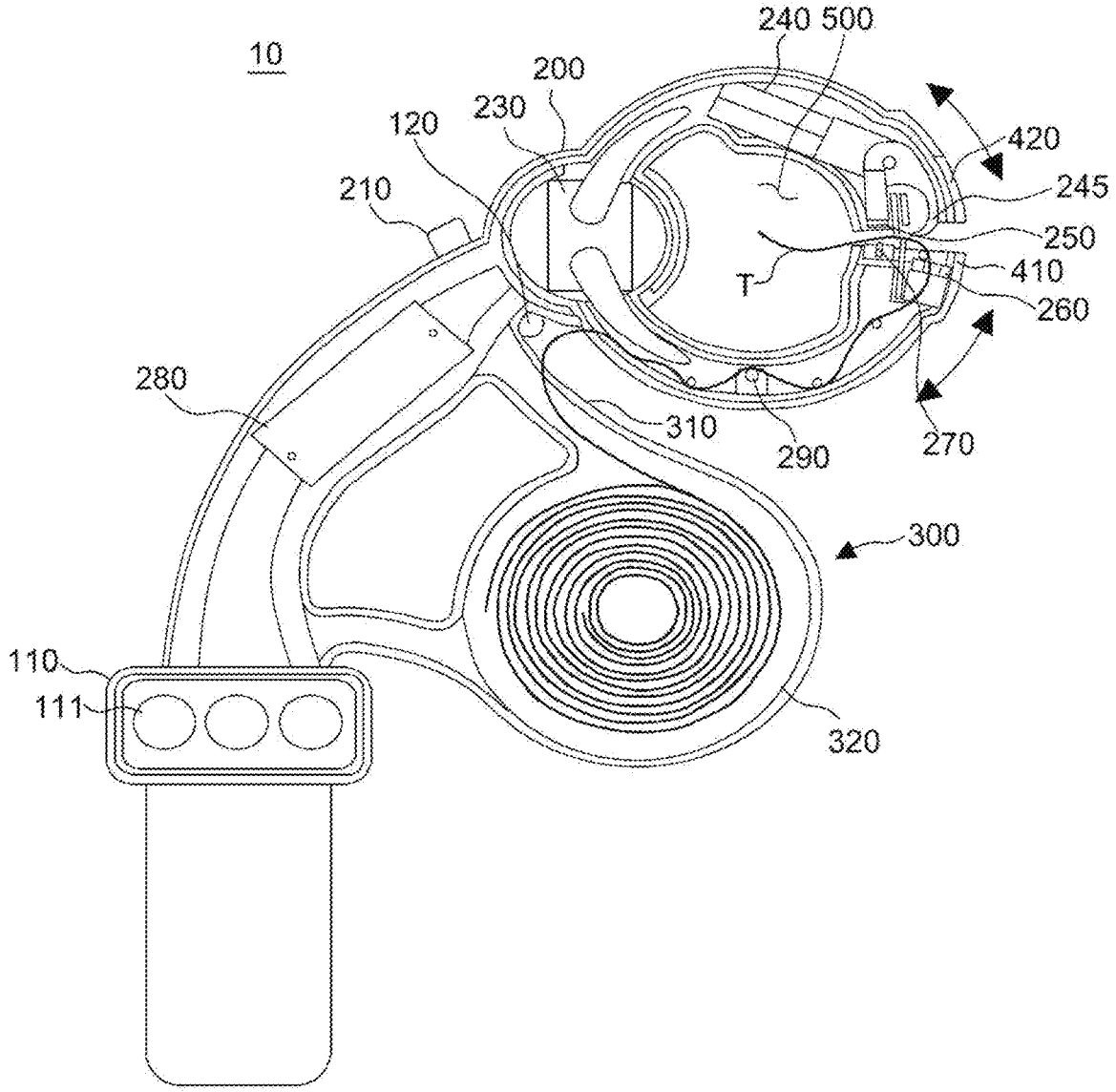
FIG. 2 is a diagram showing an internal configuration of the automatic system heat fusion-type binding machine for gardening according to the present invention.

The description describes a configuration of the automatic system heat fusion-type binding machine for gardening according to the present invention that binds the crop to the support in more detail with reference to FIG. 2.

FIG. 2 is a diagram showing an internal configuration of the automatic system heat fusion-type binding machine for gardening according to the present invention.

Referring to FIG. 2, the automatic system heat fusion-type binding machine 10 for gardening according to the present invention may include: the tape supply unit 300 including a tape container 320 attached to the handle body 100 and mounted with the tape T, and a tape guide unit 310 guiding withdrawal of the tape T; a power supply unit 110 disposed at the handle body 100 and supplying power for the heat fusion of the tape T; the pair of arms 400 facing each other, coupled to one side of the handle body 100 for at least one arm to be pivotable to thus form a binding region 500 along its inner periphery, and each having one end opened during the binding work to form an opening through which a crop 510 (see FIG. 3) and a support 520 (see FIG. 3) may enter or exit the binding region 500; the pivotal coupling unit 200 pivotably coupling the other end of each of the pair of arms 400 to the handle body 100; and a control unit 280 controlling the pivotal coupling unit 200 to automatically pivot at least one of the pair of arms 400 to perform the binding work.

The handle body 100 of the automatic system heat fusion-type binding machine for gardening according to the present invention may be held by a worker's hand when the worker performs the binding work, and include the power supply unit 110 supplying power for the heat fusion of the tape T.

Here, the power supply unit 110 may be a component supplying power to a device from a typical portable power source 111. For example, the power supply unit 110 may include an electronic element and a circuit such as an electrical contact, a connector, or a converter and/or a regulator for power conversion. Here, the portable power source may include a primary battery or a secondary battery, and is not limited to either one.

A power switch unit 120 may be a component disposed at the handle body 100 and controlling turn-on/turn-off power to control the heat fusion and other operations of the tape T, and a resulting power control state may be displayed on a light emitting unit 210.

The tape supply unit 300 may include the tape container 320 disposed on one side thereof, and may be attached to various locations, such as the side or bottom of the handle body 100, and its location is not limited thereto.

The tape supply unit 300 may include the tape container 320 disposed on one side of the handle body 100, and mounted with the tape T usually wound in the form of a cylindrical reel, and the tape guide unit 310 guiding the withdrawal of the tape T.

The pair of arms 400 may face each other, may be coupled to the handle body at the pivotal coupling unit 200 disposed on one side of the handle body 100 for at least one arm to be pivotable, and may form the binding region 500 where the binding work is performed along the inner periphery.

Here, the pair of arms 400 may respectively open one ends during the binding work to form the opening therebetween, the opening allowing the crop 510 (see FIG. 3) and the support 520 (see FIG. 3) to enter or exit the binding region 500.

In addition, the machine may further include an entry detection sensor (not shown) disposed at one ends of the pair of arms 400 and detecting that the crop and the support enter or exit through the opening.

The entry detection sensor may be a component additionally detecting that the crop and the support, which are completely bound to each other, already exit the binding region 500, and may be implemented in various forms although not shown in the drawing. For example, as an implementation example, the entry detection sensor may be an optical sensor having a light emitting unit and a light receiving unit each disposed at one end of either one of the pair of arms. The control unit 280 may allow the binding work to be performed by controlling each component based on a binding operation after the power switch unit 120 is turned on, and supplying power required for the binding operation to the pivotal coupling unit and a fusion hot wire 270.

In addition, the control unit may control an operation of preheating the fusion hot wire 270 at an initial time point at which the binding work starts. Through this configuration, the automatic system heat fusion-type binding machine for gardening according to the present invention may prevent a fusion force of the tape T from being reduced due to the prolonged heating time or lower fusion temperature of the fusion hot wire 270 during an initial binding operation.

In addition, the control unit 280 may control the pivotal coupling unit 200 to automatically pivot at least one of the pair of arms 400 to thus perform the binding work.

The pivotal coupling unit 200 may pivotably couple the other end of each of the pair of arms 400 to the handle body 100.

Here, the pivotal coupling unit 200 may include an arm driving unit 230 controlling the pivoting of at least one of the pair of arms for the pair of arms 400 to be opened or closed at a predetermined angle.

Here, the arm driving unit may include a motor. In particular, the arm driving unit may further include a gear element to reduce a rotational speed of the motor and increase a torque, or may be a geared motor in which a gear is coupled to the motor.

The pair of arms may include a first arm 410 having a withdrawal opening which is formed in its one end and through which the tape T is withdrawn, and a second arm 420 facing the withdrawal opening of the first arm and including the tape tow unit 245 controlled to capture an end of the tape T withdrawn through the withdrawal opening of the first arm when the tape T is towed.

In addition, before the binding, the arm driving unit 230 may pivot the pair of arms 400 at the predetermined angle to form the opening for the crop 510 (see FIG. 3) and the support 520 (see FIG. 3) to be bound to each other to be inserted into the binding region 500, and after the binding is completed, the arm driving unit 230 may pivot the pair of arms 400 at the predetermined angle to form the opening again for the crop and the support to exit the binding region 500.

The tape tow unit 245 may be operated to capture the end of the tape T withdrawn through the withdrawal opening of the first arm to tow and withdraw the tape T when the pair of arms 400 are opened at the predetermined angle.

A tape tow driving unit 240 may drive and control the operation of the tape tow unit 245 for the tape tow unit 245 to capture or release the end of the tape T.

The fusion hot wire 270 may be disposed at one end of either one of the pair of arms (e.g., first arm 410 in the drawing), and its heat may be controlled to a fusion temperature to heat fuse the tape when one ends of the pair of arms press the tape T against each other in a heat fusion/cutting step.

A heat detection sensor unit 250 may be disposed at one end of the other one (e.g., second arm 420 in the drawing) of the pair of arms that faces the fusion hot wire 270, and may detect the fusion temperature during the heat fusion performed in the heat fusion/cutting step for the control unit to control the fusion hot wire to an appropriate fusion temperature or fusion time, thereby achieving a higher binding quality.

Here, the control unit may control the heat fusion to be continued until the fusion temperature reaches a predetermined temperature or the fusion time elapses a predetermined time during the heat fusion.

A tape detection sensor unit 260 may be a component disposed around the withdrawal opening of the pair of arms 400 and detecting whether the tape T is discharged outside the withdrawal opening. The tape detection sensor unit 260 may perform a tape capture/tow work based on whether the discharge is detected or notify a user when to replace the tape.

A withdrawal length detection unit 290 may be a component disposed on a certain point in a withdrawal path of the tape, and detecting a withdrawal length of the tape withdrawn when the crop and the support enter the binding region 500 in an insertion detection step. The withdrawal length detection unit 290 may be controlled to output a withdrawal detection signal corresponding to the withdrawal length to the control unit 280.

Here, the control unit 280 may receive the withdrawal detection signal output from the withdrawal length detection unit 290 to detect the length of the withdrawn tape T when the crop and the support enter the binding region in the insertion detection step. Here, as an implementation example, the withdrawal length detection unit 290 may be an encoder generating an electrical signal based on the withdrawal of the tape.

Through this configuration, the withdrawal length detection unit 290 may transmit, to the control unit 280, the withdrawal detection signal based on the withdrawal of the tape T, and the control unit 280 may receive this signal, determine whether the length of the withdrawn tape T is a predetermined length, and perform the heat fusion by pressing the tape by using one end of the pair of arms when the tape is withdrawn to the predetermined length in the insertion detection step.

Here, the withdrawal length of the tape to perform the heat fusion work may be set variously based on various conditions. For example, a different withdrawal length may be set based on the thickness or type of the crop or the support. The length may be set long if the crop or the support is thick, and may be set short if the crop or the support is thin.

In this way, the automatic system heat fusion-type binding machine for gardening may perform repetitive binding works quickly and efficiently while securing a consistent binding quality by winding the tape T around the crop branch and the support pole or the drawstring, then fusing the tape by heat generated by the fusion hot wire 270 to thus bind the crop 510 (see FIG. 3) and the support 520 (see FIG. 3) to each other, and also automatically performing a process of cutting the tape T by using a cutting blade C.

The description describes an operation of binding the crop and the established pole performed by the automatic system heat fusion-type binding machine for gardening according to the present invention in detail for each step with reference to FIGS. 4 to 9.

Figure 3:
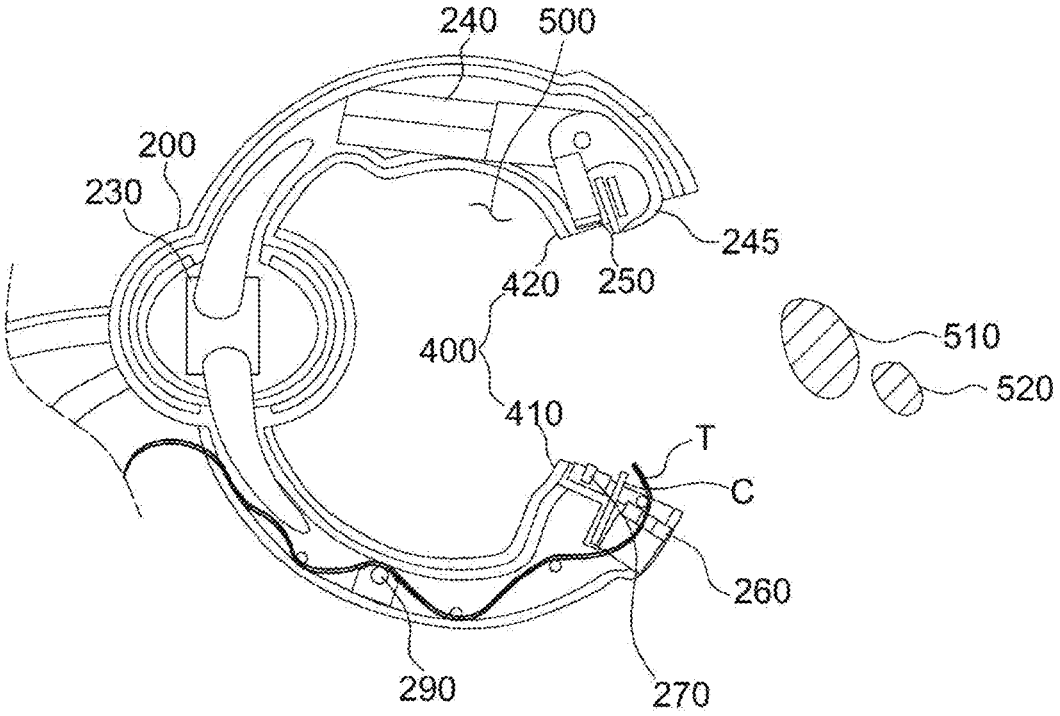
FIG. 3 is a diagram showing a preparation state of the automatic system heat fusion-type binding machine for gardening according to the present invention.
Figure 4:
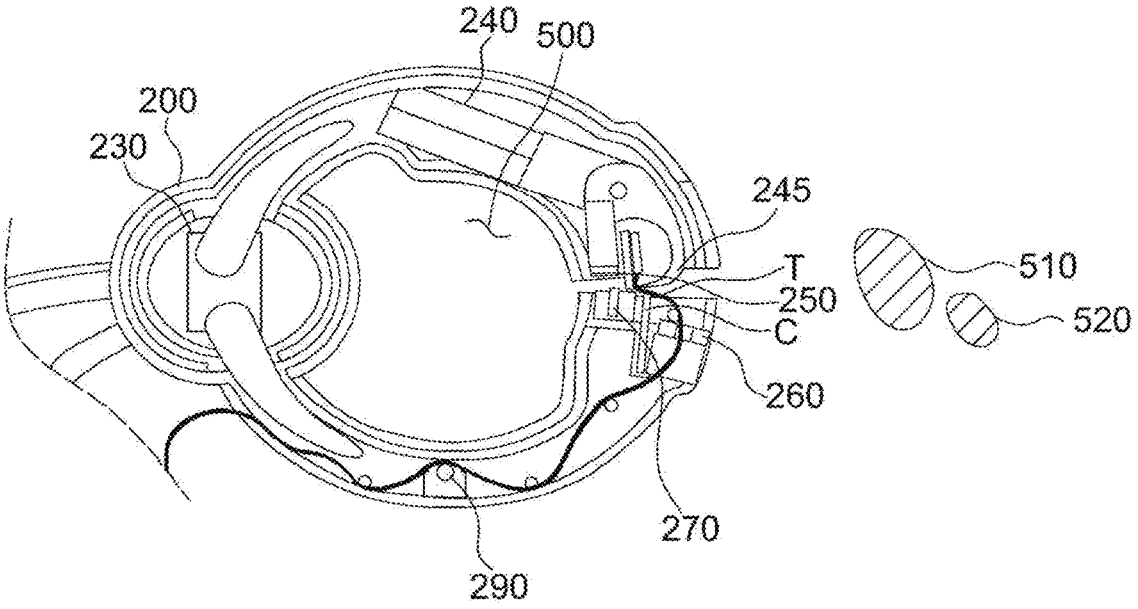
FIG. 4 is a diagram showing a state where a tape tow unit of the automatic system heat fusion-type binding machine for gardening captures a tape according to the present invention.

FIG. 3 is a diagram showing a preparation state of the automatic system heat fusion-type binding machine for gardening according to the present invention, and FIG. 4 is a diagram showing a state where the tape tow unit of the automatic system heat fusion-type binding machine for gardening captures the tape according to the present invention.

As shown in FIG. 3, a preparation step of the automatic system heat fusion-type binding machine for gardening may be a step of automatically pivoting at least one of the pair of arms 400 to prepare to perform the binding work.

The preparation step in FIG. 3 may indicate a state of the binding machine, where power is initially turned on or a previous binding work is completed and the crop 510 and the support 520, which are completely bound to each other, already exit the binding region 500.

The automatic system heat fusion-type binding machine for gardening of the present invention may maintain a standby state for a predetermined time, and then start a tape withdrawal operation shown in FIG. 4 to prepare for the next binding work.

The control unit 280 may control the pivotal coupling unit 200 to automatically pivot at least one of the pair of arms for one end of each of the pair of arms to be closed, and the tape tow unit 245 may perform an operation of capturing the end of the tape T withdrawn through the withdrawal opening. The control unit 280 may then perform a tape withdrawal step of controlling the pair of arms to withdraw the captured tape T while being opened at the predetermined angle.

In the tape withdrawal step, the tape detection sensor unit 260 may detect whether the tape T is discharged through the withdrawal opening, and the tape tow unit 245 may be controlled to capture the end of the tape when the tape is detected as being withdrawn.

Here, the tape tow driving unit 240 may drive and control the tape tow unit 245 for the tape tow unit 245 to capture the end of the tape T withdrawn through the withdrawal opening.

Figure 5:
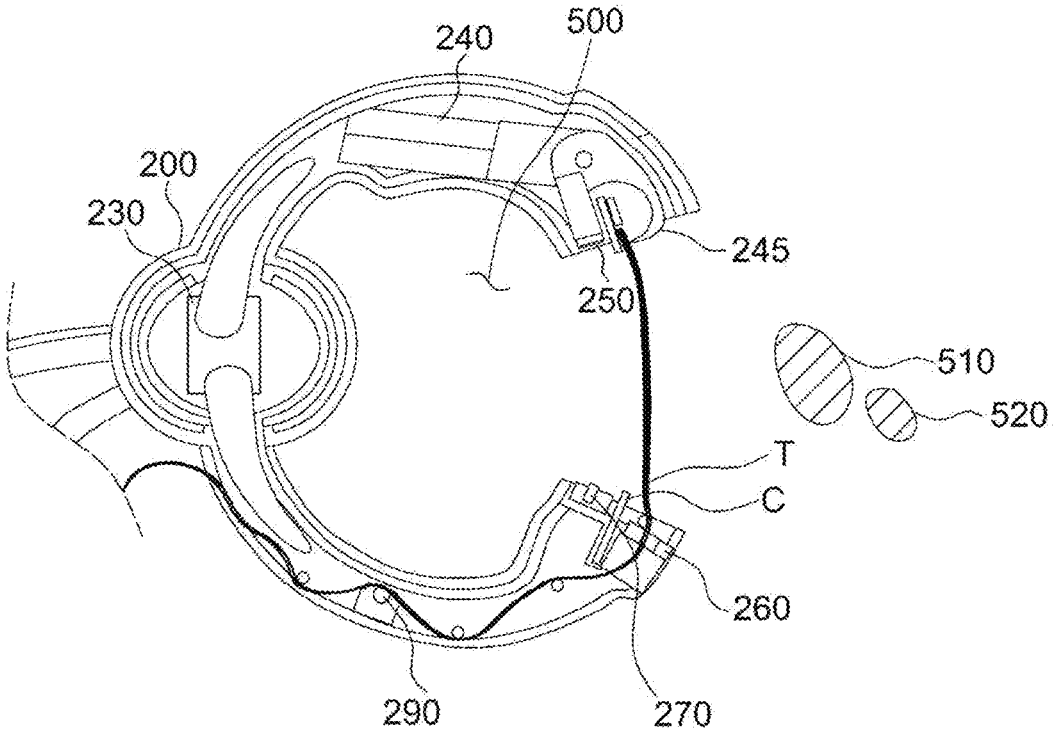
FIG. 5 is a diagram showing a state where the automatic system heat fusion-type binding machine for gardening stands by for a binding work after the tape is withdrawn.

FIG. 5 is a diagram showing a state where the automatic system heat fusion-type binding machine for gardening stands by for the binding work after the tape is withdrawn.

Referring to FIG. 5, the work standby state of the automatic system heat fusion-type binding machine for gardening may be a work standby step where the binding machine stands by until the crop 510 and the support 520 pass through the opening while the tape T is put between one end of the first arm and one end of the second arm by crossing the opening after the tape withdrawal step. In the work standby state, the tape that is captured and withdrawn may have a predetermined tension and be prevented from being loosened.

The insertion detection step may be performed when the crop 510 and the support 520, which are targets of the binding work, are inserted into the binding region 500 through the opening in this step.

Figure 6:
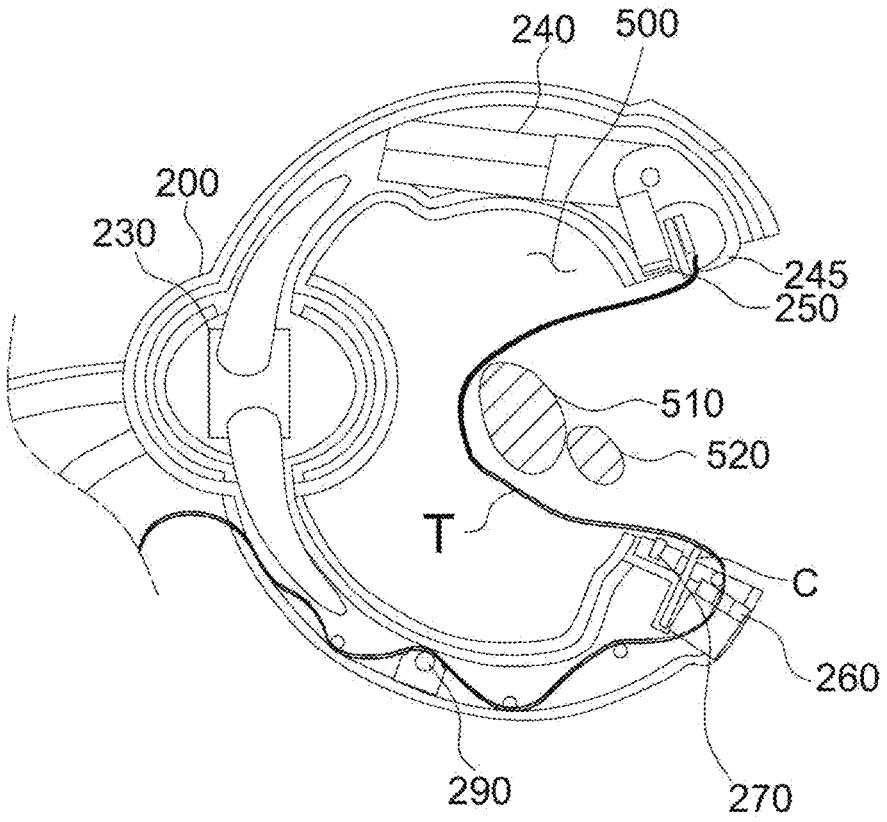
FIG. 6 is a diagram showing a state where a crop and its support are inserted into a binding region.

FIG. 6 is a diagram showing a state where the crop and its support are inserted into the binding region. Referring to FIG. 6, a crop insertion detection step of the automatic system heat fusion-type binding machine for gardening may be a step where the crop 510 and the support 520 are inserted into the binding region 500 through the opening between one end of the first arm and one end of the second arm. Here, the insertion state and degree of the target may be detected by the withdrawal length detection unit 290 disposed on the certain point of the withdrawal path of the tape and detecting the withdrawal length of the tape.

In addition, the crop insertion detection step may be a step of detecting whether the crop 510 and the support 520 pass through the opening from the outside to the binding region, and may be performed by the entry detection sensor installed at one ends of the pair of arms. Here, the entry detection sensor may be disposed at one ends of the pair of arms 400 and detecting that the crop 510 and the support 520 enter or exit through the opening, i.e. the crop 510 and the support 520 start to enter the binding region 500 or the crop 510 and the support 520, which are completely bound to each other, already exit the binding region 500.

Figure 7:
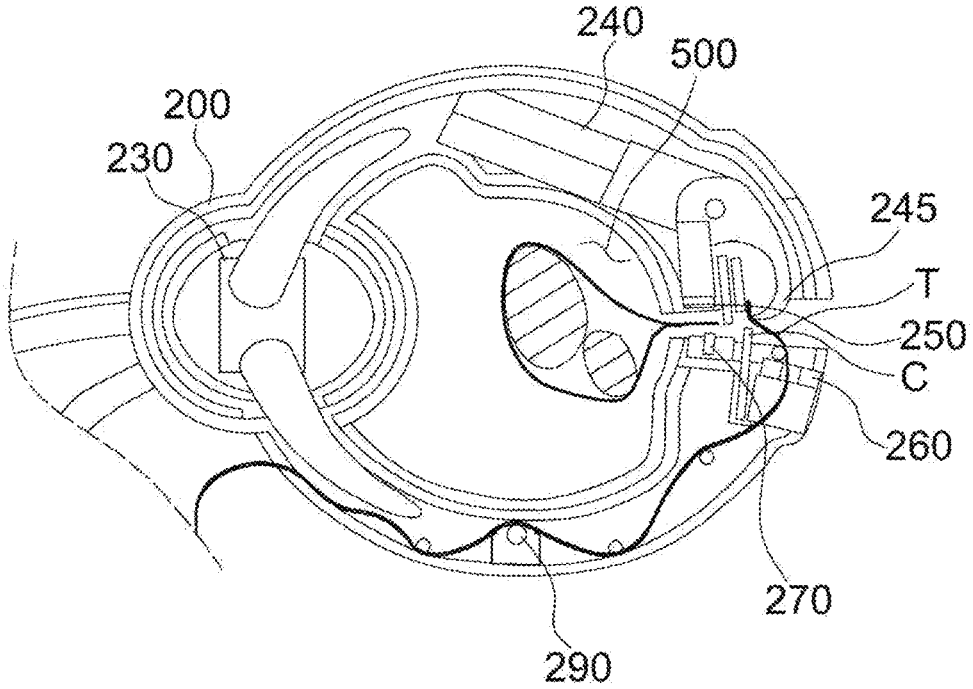
FIG. 7 is a diagram showing a state where heat fusion/cutting is performed.

FIG. 7 is a diagram showing a state where the heat fusion/cutting is performed.

Referring to FIG. 7, the heat fusion/cutting step performed by the automatic system heat fusion-type binding machine for gardening is a step of heat fusing/cutting the tape T by pressing one end of each of the pair of arms 400 when the tape T is withdrawn to a predetermined withdrawal length or more in the crop insertion detection step shown in FIG. 6.

Here, the withdrawal length of the tape may be identified by the withdrawal length detection unit 290 disposed on the certain point of the withdrawal path of the tape and detecting the withdrawal length of the tape.

The heat fusion/cutting step may start as the crop and the support enter the binding region and the tape is withdrawn to a predetermined length in the insertion detection step, and in this step, the tape may be heat fused by the fusion hot wire 270 when one ends of the pair of arms press the tape T against each other, and the heat fused tape may be cut by using the cutting blade C.

The automatic system heat fusion-type binding machine for gardening according to the present invention may further include the heat detection sensor unit 250 detecting the fusion temperature of the fusion performed using the fusion hot wire. In order to accurately detect the fusion temperature, it is preferable that the heat detection sensor unit 250 is disposed on a fusion area of the tape that is heat fused, that is, on one end of one of the pair of arms that faces the fusion hot wire. The control unit may detect the fusion temperature during the heat fusion through the heat detection sensor unit 250, and continue the heat fusion until the fusion temperature reaches the predetermined temperature. Additionally or alternatively, the control unit may control the fusion hot wire for the heat fusion to be continued until the fusion time elapses the predetermined time after the heat fusion starts.

Figure 8:
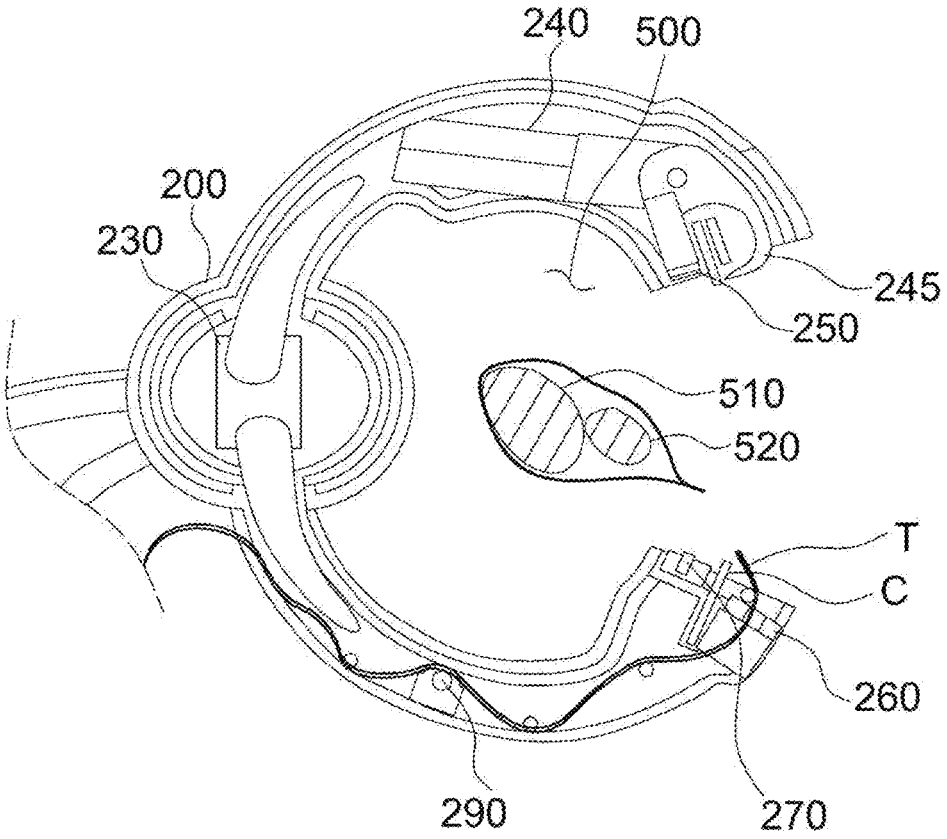
FIG. 8 is a diagram showing a state where a binding work is completed.

FIG. 8 is a diagram showing that the binding work is completed.

Referring to FIG. 8, in a binding completion step, the crop and the support may be completely bound to each other by the heat fused tape T after the heat fusion/cutting step.

The arm driving unit 230 may be controlled to pivot the pair of arms at the predetermined angle to form the opening for the crop 510 and the support 520, which are completely bound to each other in the binding completion step, to exit the binding region.

For reference, the different predetermined angle formed by the pair of arms in order to form the opening in the work standby step, insertion detection step, or binding completion step of the present invention may be set not only based on the type and thickness of the crop 510 or the support 520, which is the work target, but also for each step.

In addition, the automatic system heat fusion-type binding machine for gardening according to the present invention may further include the entry detection sensor (not shown) installed at one ends of the pair of arms and detecting that the crop 510 and the support 520 enter or exit through the opening.

Accordingly, the binding completion step of the present invention may be maintained at least until the crop 510 and the support 520 are detected as already exiting the binding region 500 through the opening by the entry detection sensor.

Additionally or alternatively, the binding completion step of the present invention may be defined as being continued until the predetermined time elapses after the heat fusion/cutting step.

The heat fusion-type binding machine for gardening according to the present invention may be controlled to automatically perform the consecutive and repetitive binding operations by entering the tape withdrawal step to prepare for the next binding work after the binding completion step where the binding work is completed.

Figure 9:
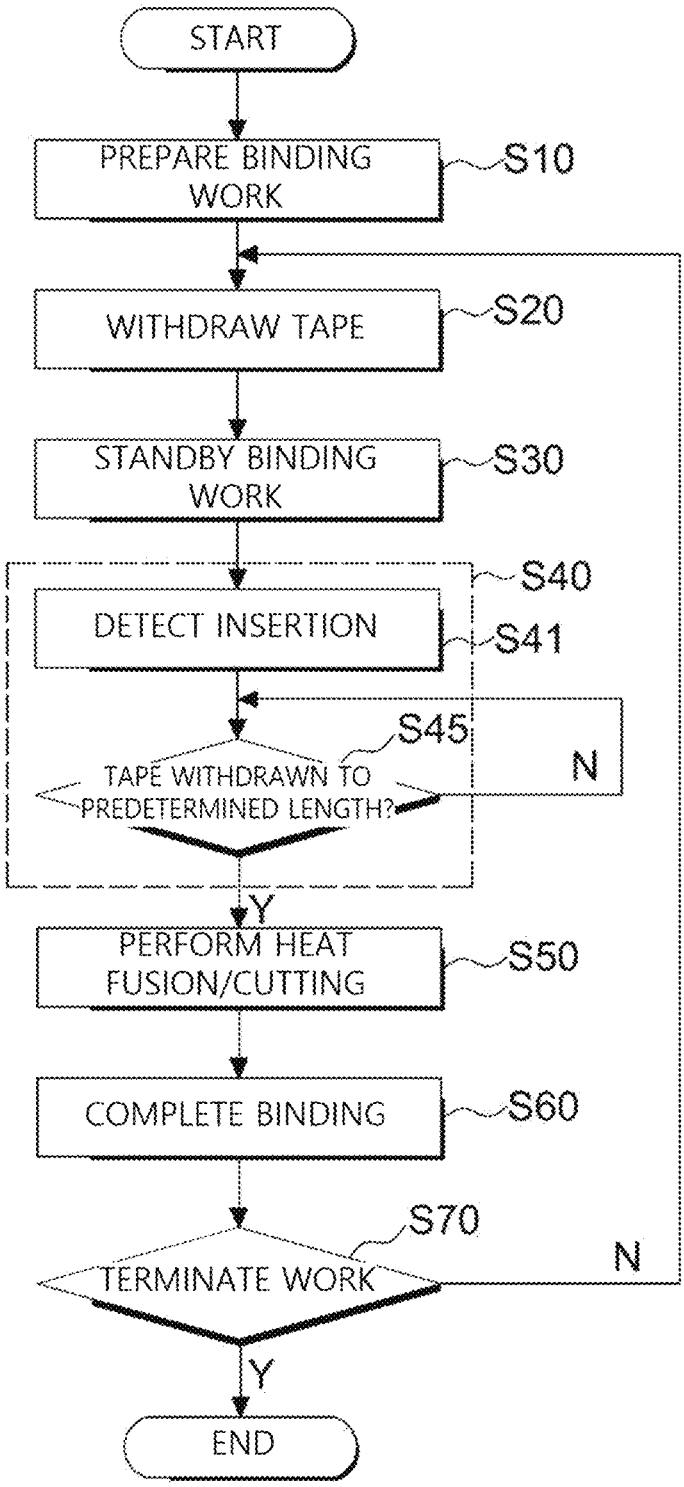
FIG. 9 is a flow chart showing a control method of an automatic system heat fusion-type binding machine for gardening according to the present invention.

FIG. 9 is a flow chart showing a control method of an automatic system heat fusion-type binding machine for gardening according to the present invention.

Referring to FIG. 9, the control method of an automatic system heat fusion-type binding machine for gardening according to the present invention may include: a binding work preparation step S10 in a state where a pair of arms is opened at a predetermined angle, and a portion of a tape is withdrawn through a withdrawal opening formed in one end of either one of the pair of arms 400; a tape withdrawal step S20 of capturing an end of the tape T, withdrawn through the withdrawal opening, by the other arm side of the pair of arms after the pair of arms 400 is closed, and withdrawing the captured tape T while the pair of arms 400 is opened at the predetermined angle; a binding work standby step S30; a crop insertion detection step S40 of detecting whether a crop and a support are inserted into a binding region; and a heat fusion/cutting step S50 of heat fusing/cutting the tape T by pressing one end of each of the pair of arms 400 after the crop and the support enter the binding region.

Here, the crop insertion detection step S40 may include an insertion detection step S41 of detecting whether the crop and the support pass through an opening formed between one ends of the pair of arms from the outside to the binding region, and a step S45 of determining whether the tape is withdrawn to a length necessary to bind the crop and the support to each other when the tape is withdrawn as the crop and the support are inserted into the binding region.

In order to detect the withdrawal length of the tape, the automatic system heat fusion-type binding machine for gardening according to the present invention may further include a withdrawal length detection unit 290 disposed on a certain point of the withdrawal path and detecting the withdrawal length of the tape in the insertion detection step.

The heat fusion/cutting step S50, which is the next step, may be performed when the tape T is determined to be withdrawn to a predetermined withdrawal length or more by the withdrawal length detection unit 290 (in the step S45). Otherwise, the crop insertion detection step may be maintained until the crop and the support are inserted enough for the tape to be withdrawn to the predetermined withdrawal length.

The heat fusion in the heat fusion/cutting the step S50 may be controlled to be continued until a fusion temperature reaches a predetermined temperature or a fusion time elapses a predetermined time.

In addition, the control method of an automatic system heat fusion-type binding machine for gardening according to the present invention may further include a binding completion step of completely binding the crop and the support to each other by the heat fused tape.

In the binding completion step, the arm driving unit 230 may be controlled to pivot the pair of arms at the predetermined angle to form the opening for the crop 510 and the support 520, which are completely bound to each other, to exit the binding region.

In addition, the binding completion step of the present invention may be maintained at least until the crop and the support are detected as already exiting the binding region through the opening by an entry detection sensor 220 installed at one ends of the pair of arms and detecting that the crop and the support enter or exit through the opening.

Additionally or alternatively, the binding completion step of the present invention may be defined as being continued until a predetermined time elapses after the heat fusion/cutting step.

The binding completion step may be at least partially included in the preparation step before the withdrawal step of capturing and withdrawing the tape in the operation steps of the heat fusion-type binding machine for gardening according to the present invention.

The heat fusion-type binding machine for gardening according to the present invention may be controlled to automatically perform consecutive and repetitive binding operations by entering the tape withdrawal step to prepare for the next binding work after the binding completion step where the binding work is completed.

The heat fusion-type binding machine for gardening of the present invention may enter the tape withdrawal step S20 to prepare for the next binding work after the binding completion step S60, or terminate the work by performing a work termination step S70 of using a manipulation such as turning off a power switch or instructing a separate work termination or the like.

Through the above-described configuration, the automatic system heat fusion-type binding machine and the method thereof for gardening according to the present invention may not only increase the convenience of the binding work by automatically performing the tape binding work, but also improve the binding work quality and minimize the worker fatigue occurring due to the repetitive binding works by maintaining the consistent binding force of the tape regardless of the worker's skill level.

As set forth above, the automatic system heat fusion-type binding machine and the method thereof for gardening according to the present invention may improve the convenience of the binding work by automatically setting the tape binding work.

In addition, the automatic system heat fusion-type binding machine and the method thereof for gardening according to the present invention may improve the binding work quality and minimize the worker fatigue occurring due to the repetitive binding works by maintaining the consistent binding force of the tape through the tape binding work that is set to be automatic.

Hereinabove, the present invention is described and illustrated based on the embodiments illustrating a principle of the present invention. However, the present invention is not limited to the configuration and operation shown and described as above. It is apparent to those skilled in the art to which the present invention pertains that the present invention may be embodied in another specific form without changing the technical idea or essential characteristics of the present invention. Therefore, it is to be understood that the embodiments described hereinabove are illustrative rather than restrictive in all aspects. It is to be understood that the scope of the present invention is defined by the claims, and all modifications and alternations derived from the meaning and scope of the claims and their equivalents are included in the scope of the present invention.

What is claimed is:

1. A heat fusion-type binding machine for gardening, which performs a work of binding a crop and a support to each other by heat fusing a tape, the machine comprising:

a handle body;

a tape supply unit including a tape container attached to the handle body and mounted with the tape, and a tape guide unit guiding withdrawal of the tape;

a power supply unit disposed at the handle body and supplying power for the heat fusion of the tape;

a pair of arms facing each other, coupled to one side of the handle body for at least one arm to be pivotable to thus form a binding region along its inner periphery, and each having one end opened during the binding work to form an opening through which the crop and the support enter or exit the binding region;

a pivotal coupling unit pivotably coupling the other end of each of the pair of arms to the handle body; and a control unit controlling the pivotal coupling unit to automatically pivot at least one of the pair of arms to perform the binding work.

2. The machine of claim 1, wherein the pivotal coupling unit includes an arm driving unit controlling the pivoting of at least one of the pair of arms for the pair of arms to be opened or closed at a predetermined angle, and the pair of arms includes a first arm having a withdrawal passage formed along a withdrawal path of the tape therein, and having a withdrawal opening which is formed in its one end and through which the tape is withdrawn to the outside, and a second arm facing the withdrawal opening of the first arm, and including a tape tow unit controlled to capture an end of the tape withdrawn through the withdrawal opening of the first arm when the tape is towed.

3. The machine of claim 2, in which the binding work includes a tape withdrawal step of controlling the tape tow unit to capture the end of the tape withdrawn through the withdrawal opening, and withdraw the tape while the pair of arms is opened at the predetermined angle, wherein the second arm further includes a tape tow driving unit driving the tape tow unit for the tape tow unit to capture the end of the tape in the tape withdrawal step.

4. The machine of claim 3, in which the binding work further includes a work standby step of standing by until the crop and the support pass through the opening while the tape is put between the one end of the first arm and the one end of the second arm by crossing the opening after the tape withdrawal step, and an insertion detection step of detecting whether the crop and the support pass through the opening formed between the one end of the first arm and the one end of the second arm from the outside to the binding region, further comprising a withdrawal length detection unit disposed on a certain point in the withdrawal path of the tape and detecting a withdrawal length of the tape, in the insertion detection step.

5. The machine of claim 4, in which the binding work further includes a heat fusion/cutting step of heat fusing/cutting the tape by pressing the one end of each of the pair of arms when the tape is withdrawn to a predetermined withdrawal length or more in the insertion detection step, further comprising:

a fusion hot wire disposed at the one end of either one of the pair of arms, and heat fusing the tape when the one ends of the pair of arms press the tape against each other in the heat fusion/cutting step; and a cutting blade disposed at the one end of either one of the pair of arms, and cutting the heat fused tape in the heat fusion/cutting step.

6. The machine of claim 5, further comprising a heat detection sensor unit disposed at the one end of the other one of the pair of arms that faces the fusion hot wire, and detecting a fusion temperature during the heat fusion performed in the heat fusion/cutting step, wherein the heat fusion is continued until the fusion temperature reaches a predetermined temperature or a fusion time elapses a predetermined time.

7. The machine of claim 5, in which the binding work further includes a binding completion step of completely binding the crop and the support to each other by the heat fused tape after the heat fusion/cutting step, wherein the arm driving unit pivots the pair of arms at the predetermined angle to form the opening for the crop and the support, which are completely bound to each other in the binding completion step, to exit the binding region.

8. The machine of claim 7, further comprising an entry detection sensor disposed at the one ends of the pair of arms, and detecting that the crop and the support enter or exit through the opening, wherein the binding completion step is continued until the crop and the support, which are completely bound to each other, are detected as already exiting the binding region by the entry detection sensor, or until a predetermined time elapses after the heat fusion/cutting step.

9. The machine of claim 8, wherein the machine is automatically controlled for the binding work to enter the tape withdrawal step after the binding completion step.

10. A control method of the automatic system heat fusion-type binding machine for gardening of claim 1, the method comprising:

a binding work preparation step in a state where a pair of arms is opened at a predetermined angle, and a portion of a tape is withdrawn through a withdrawal opening formed in one end of either one of the pair of arms;

a tape withdrawal step of capturing an end of the tape, withdrawn through the withdrawal opening, by the other arm side of the pair of arms after the pair of arms is closed, and withdrawing the tape while the pair of arms is opened at the predetermined angle;

an insertion detection step of detecting whether a crop and a support pass through an opening formed between one ends of the pair of arms from the outside to a binding region;

a heat fusion/cutting step of heat fusing/cutting the tape by pressing the one end of each of the pair of arms after the crop and the support enter the binding region; and a binding completion step of completely binding the crop and the support to each other by the heat fused tape.

11. The method of claim 10, in which the machine further includes a withdrawal length detection unit disposed on a certain point in a withdrawal path of the tape, and detecting a withdrawal length of the tape in the insertion detection step, wherein the heat fusion/cutting step is performed when the tape is determined to be withdrawn to a predetermined withdrawal length or more by the withdrawal length detection unit in the insertion detection step.

12. The method of claim 10, wherein the heat fusion in the heat fusion/cutting step is continued until a fusion temperature reaches a predetermined temperature or a fusion time elapses a predetermined time.

* * * * *